US007398962B2

(12) United States Patent
Cooper

(10) Patent No.: US 7,398,962 B2
(45) Date of Patent: Jul. 15, 2008

(54) QUICK JET CHANGE FUEL FLOAT BOWL

(76) Inventor: Patrick Cooper, 710 W. Clady Dr., Spring, TX (US) 77386

( * ) Notice: Subject to any disclaimer, the term of this patent is extended or adjusted under 35 U.S.C. 154(b) by 90 days.

(21) Appl. No.: 11/480,988

(22) Filed: Jul. 6, 2006

(65) Prior Publication Data

US 2007/0013086 A1 Jan. 18, 2007

Related U.S. Application Data

(60) Provisional application No. 60/697,554, filed on Jul. 11, 2005.

(51) Int. Cl.
*F02M 5/16* (2006.01)
*F02M 17/36* (2006.01)

(52) U.S. Cl. ..... 261/70; 29/888.011; 261/72.1

(58) Field of Classification Search ..... 261/70, 261/72.1, 23.2; 29/888.011
See application file for complete search history.

(56) References Cited

U.S. PATENT DOCUMENTS

| | | | | |
|---|---|---|---|---|
| 1,066,151 | A | 7/1913 | Rice | |
| 2,633,342 | A * | 3/1953 | Baker | 261/52 |
| 3,263,975 | A * | 8/1966 | Wu | 261/70 |
| 3,372,912 | A * | 3/1968 | Benmore | 261/36.2 |
| 3,661,367 | A | 5/1972 | Mennesson | |
| 3,758,082 | A * | 9/1973 | Kertell | 261/23.2 |
| 3,875,267 | A * | 4/1975 | Seki et al. | 261/70 |
| 3,985,836 | A * | 10/1976 | Fischer | 261/39.2 |
| 4,034,026 | A * | 7/1977 | Miller | 261/23.2 |
| 4,100,663 | A | 7/1978 | Crum | |
| 4,277,423 | A | 7/1981 | Noguez | |
| 4,464,312 | A * | 8/1984 | Zaita | 261/70 |
| 4,556,032 | A * | 12/1985 | Miller | 123/438 |
| 4,737,319 | A * | 4/1988 | Saxby | 261/34.1 |
| 5,283,011 | A * | 2/1994 | McClintic et al. | 261/23.2 |
| 5,591,383 | A | 1/1997 | Krup | |
| 5,667,730 | A | 9/1997 | Barfield | |
| 5,776,377 | A | 7/1998 | Hammel, Jr. | |
| 6,244,572 | B1 | 6/2001 | Delsole | |
| 6,286,817 | B1 | 9/2001 | Grant | |
| 6,364,291 | B1 | 4/2002 | Grant | |
| 6,554,258 | B2 | 4/2003 | Braswell | |
| 2003/0030156 | A1 * | 2/2003 | Fujino et al. | 261/70 |

FOREIGN PATENT DOCUMENTS

| | | | | |
|---|---|---|---|---|
| JP | 59-160062 A * | 9/1984 | | 261/70 |

* cited by examiner

*Primary Examiner*—Richard L Chiesa

(57) ABSTRACT

Replacement of the fuel metering jets of an internal combustion engine carburetor, such as a Holley.RTM. or Demon-.RTM. Carburetor is greatly simplified by fuel float bowls which permit the jets to face upward. The jets are removed through access holes in the upper wall of the float bowl by a screwdriver/gripping tool. The float has access holes which are aligned to the upper wall holes to provide direct access to the fuel metering jets.

6 Claims, 5 Drawing Sheets

TYPICAL CARBURETOR

SECTION a-a

SECTION c-c

SECTION b-b

SECTION d-d

QUICK JET CHANGE FUEL FLOAT BOWL

CROSS-REFERENCE TO RELATED APPLICATIONS

This application claims the benefit of provisional patent application Ser. No. 60/697,554 filed 2005 Jul. 11 by the present inventor.

FEDERALLY SPONSORED RESEARCH

Not Applicable

SEQUENCE LISTING OR PROGRAM

Not Applicable

BACKGROUND OF THE INVENTION

1. Field of Invention

The present invention pertains to carburetors for use in internal combustion engines, specifically carburetors including a metering block attached to the side or sides of the carburetor and a float bowl attached to the side of the metering block.

2. Prior Art

In the past, carburetors have been provided for delivering a predetermined, calibrated mixture of air and fuel into the intake manifold of an internal combustion engine. Fuel that is to be mixed with air and delivered through the carburetor to the engine is typically introduced into a reservoir known as a fuel bowl and metered directly into the intake manifold of the engine through one or more orifices, known as fuel jets or just jets, mounted in the carburetor. The diameter of the orifice in the fuel jets controls the amount of fuel that may be metered into the engine under a given set of operating characteristics. Because of this, fuel jets are frequently changed to jets having different size orifices to recalibrate the air to fuel ratio of the engine to achieve specific performance goals. Thus, the orifice diameter of the fuel jets is an important factor to be taken into account when "designing or setting up" a carburetor for a given application.

The factory location of the jets is inherently bad, due to its location being parallel to vehicles braking and acceleration axis, and is subject to becoming uncovered by fuel, causing the engine to starve for fuel during hard acceleration, deceleration, and cornering.

In order to change the jets in existing carburetors such as those manufactured by Holley.RTM. And Demon.RTM., it has been necessary to physically remove the fuel reservoir or float bowl to gain access to the jets so that they can be removed and changed to the desired jet configuration. However, before the fuel reservoir can be removed, it is necessary to somehow drain the float bowl or allow the fuel contained in the fuel bowl to simply escape when the bowl is removed from the carburetor. Because carburetors are typically mounted on top of the engine, fuel escaping from the carburetor onto the engine creates a fire hazard, especially when the engine is hot. Because of this, removal of the float bowl from a carburetor in a hot engine creates a significantly hazardous situation, both for the mechanic and those in the surrounding area. Another difficulty associated with the removal of the float bowl is that such removal often damages a gasket provided between the fuel bowl and the mating structure of the carburetor and must be replaced prior to reassembly of the float bowl to the carburetor.

In certain automotive applications, such as racing for example, it is important to be able to rapidly change the jets within the carburetor to fine tune the engine performance for the particular application. With regard to racing applications, variations in track conditions and atmospheric conditions, such as humidity and barometric pressure for example, make it desirable to have the ability to rapidly gain access to the carburetor jets to change them to jets that are appropriate for the particular track and atmospheric conditions. For example, during qualifying for a race, mechanics will typically fine tune the engine to achieve the optimal performance and thus achieve the fastest qualifying time by changing the fuel jets until the optimum engine performance is obtained. The dynamic nature of such a qualifying session demands that jet changes be performed rapidly in order to get the car back on the track as soon as possible. Moreover, during actual racing situations, it is frequently desirable to have the ability to affect rapid jet changes to compensate for changing track and atmospheric conditions or for other performance related reasons, such as fuel economy, for example.

Attempting to change the fuel jets under the demanding circumstances of prerace qualifying and actual racing situations has not been entirely successful because of the safety hazards associated with the removal of the fuel bowl from the carburetor to access the metering jets, as well as the time involved in physical removal and replacement of the fuel bowl. Even assuming that the gasket does not have to be replaced after removal of the fuel bowl, it still takes a significant amount of time to physically unbolt the fuel bowl and change the metering jets. This amount of time can be critical in qualifying and actual race situations. Holley.RTM. has produced an alternative style of float bowl for its carburetors that contains two screw-in plugs which are aligned with a vertical center line of each of the two jets associated with the primary and secondary venturies in its four-barrel carburetor design. The removable screw-in plugs allow access to the jets as they are retained in their normal position in the metering block without removing the float bowl. However, the screw-in plug arrangement for accessing the jets still requires the fuel to be drained from the float bowl before the plug is removed; otherwise, the potential hazard of flammability remains.

Inventor Crum U.S. Pat. No. 4,100,663 1978, addressed this with a kit installing 90 degree angle fittings into the metering block to allow the jet to face upwardly, drilling holes in the existing float bowl above the jets and adding plugs to the top of the float bowl. The jets are screwed into the top of the 90 degree fitting. This caused the jets inlet to be raised and causes fuel starvation to be increased. The float level would then need to be adjusted higher to compensate for the starvation. This causes raw fuel to slosh into the main body venturi during normal deceleration and acceleration, causing extreme rich conditions, engine cutout and possible fire due to backfire.

Inventors Hammel U.S. Pat. No. 5,776,377 1998, and Noguez U.S. Pat. No. 4,277,423 1981 addressed this by replacing the original metering block with one that contains the metering jets in a removable jet cartridge within a metering block that would replace the original equipment metering block provided on carburetors such as those designed by Holley.RTM. Replacing the manufacturer's metering block with an aftermarket unit may have adverse affects on the factory calibration of the metering block function.

Accordingly, it would be desirable to provide a system whereby the fuel jets could be readily removed from the carburetor assembly without the need to drain the carburetor or remove the fuel bowl to effect the change. It would be particularly desirable if the metering jets could be removed from the top of the carburetor bowl that would replace the original equipment fuel float and fuel bowl provided on carburetors such as those designed by Holley.RTM. and Demon-.RTM Corporations, to permit rapid jet removal and replacement in those applications, yet still using the manufacturer's calibrated metering block, particularly racing, that require rapid change-outs.

The function of the metering block in a typical Holley-.RTM, or Demon.RTM, carburetor is to control the amount of fuel which is delivered to an internal combustion engine by limiting fuel volume through a series of replaceable and non-replaceable orifices. The replaceable orifices are commonly known as jets. Jets typically have a portion of machine screw threads on one end and a slotted configuration on the other end to facilitate removal and installation with a standard flat blade screwdriver. The jets are identified by the diameter of the orifice contained therein. Those operating Holley.RTM. or Demon.RTM carburetor, commonly change these jets to change the amount of fuel consumed by an internal combustion engine.

Fuel that is metered by the jets is introduced into a vertical chamber that is cast into the metering block. This chamber is commonly known as the main well. Fuel entering the main well enters at the bottom where the jets are located. As previously mentioned, the jets are retained in the metering block by their machine screw threads, and are exposed to a fuel supply contained within a float bowl or a fuel bowl. Under operating conditions, the fuel bowl contains a small reservoir of fuel which is maintained and made available to the jets under normal atmospheric pressure and gravity. There is also a float control valve typically contained within the fuel bowl which allows the fuel entering the fuel bowl to be maintained at a relatively constant level within the bowl.

After fuel has passed through the jets and into the main well, a metered amount of air is introduced into the main well to mix with the fuel. This process of introducing air into the fuel is commonly referred to as "emulsion." As this process takes place, the fuel in the main well that is emulsified travels vertically upward until it reaches the height of a main well discharge passage, which is typically located near the top of the metering block. At this point, the emulsified fuel mixture exits the metering block and enters a passage commonly referred to as the main discharge nozzle where it enters and mixes with the air being consumed by the engine.

The entire mechanism for metering, emulsifying, and delivering of fuel to the carburetor's main discharge nozzle exists in a pair of identical mirror image configurations for two and four venturi carburetor applications. The venturies associated with a carburetor are commonly referred to as barrels such that a four venturi carburetor is referred to as a four-barrel carburetor. The metering blocks are configured to work in conjunction with two venturies at once. Thus, a two-barrel carburetor requires one fuel float and fuel bowl, whereas a four-barrel carburetor requires two fuel floats and two fuel bowls.

OBJECTS AND ADVANTAGES

Accordingly, besides the objects and advantages of the fuel float and fuel bowl described in my above invention, several objects and advantages of the present invention are:

(a) To provide a simple, rapid and safe means for replacing the fuel metering jets of a carburetor having side mounted fuel float bowls.

(b) Another object is to provide such means which are simple and which are to be installed on existing carburetors.

(c) Other objects will become apparent in light of the following description and accompanying drawings.

(d) In accordance with one aspect of this invention, generally stated, an improved carburetor is provided of the type including a carburetor body, a metering block, a float bowl, and float, and one or more jets threaded into the metering block, wherein the improvement comprises means on the carburetor defining an upwardly facing bore into which the jet is removable mounted into the float bowl, and a closable opening in an upper wall of the float bowl through which the jet can be removed. In the preferred embodiment, the upwardly facing bore is internally threaded. The threaded portion is sized and threaded identically with the jet. Holes in the upper wall of the float chamber provide safe, easy, rapid, access to the jet.

(e) Another object of the invention, the new location of the jets in the bottom of the float bowl, are lower than the original location and increases the jets efficiency because the jet will always be covered by fuel and will not be affected by fuel sloshing caused by acceleration, deceleration, and cornering.

SUMMARY

In accordance with the present invention a carburetor float and float bowl, allowing the relocation of the metering jets to the bottom of the float bowl, for easy removal without the added steps of removing the float bowl bolts and float bowl, spilling fuel onto hot engine manifolds.

DRAWINGS

Figures

Figure 5:
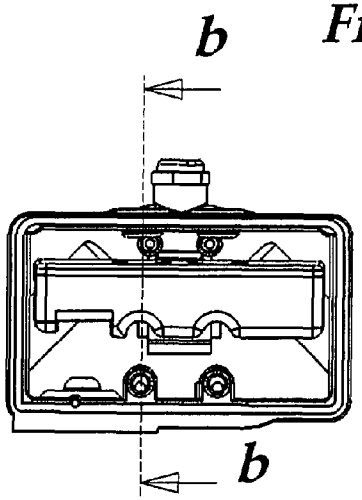
FIG. 5 shows an unexploded front view of the invention.
Figure 5A:
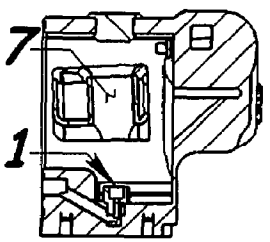

FIG. 5*a* shows sectional view b-b of FIG. 5 of the invention: (Shows the new location of the fuel jet, the fuel float and access passage).

Figure 6:
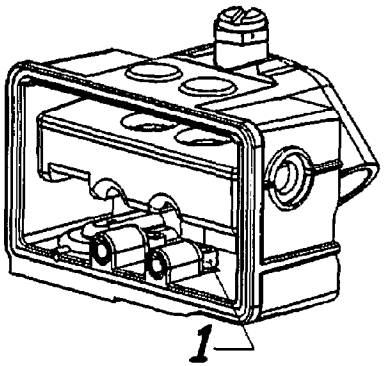

FIG. 6 shows an isometric view of the invention with all components installed in their respected positions.

Figure 7:
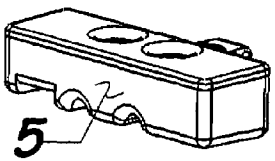

FIG. 7 shows an isometric view of this invention's fuel float.

Figure 8:
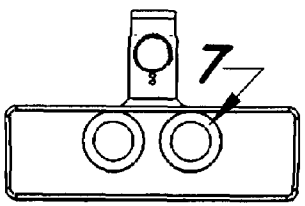

FIG. 8 shows the top view of the float.

Figure 9A:
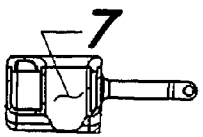
Figure 9:
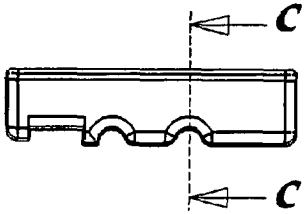

FIG. 9 shows the front view of the float.

FIG. 9*a* shows section view c-c of FIG. 9. Shows the fuel floats, jet access passage.

Figure 10:
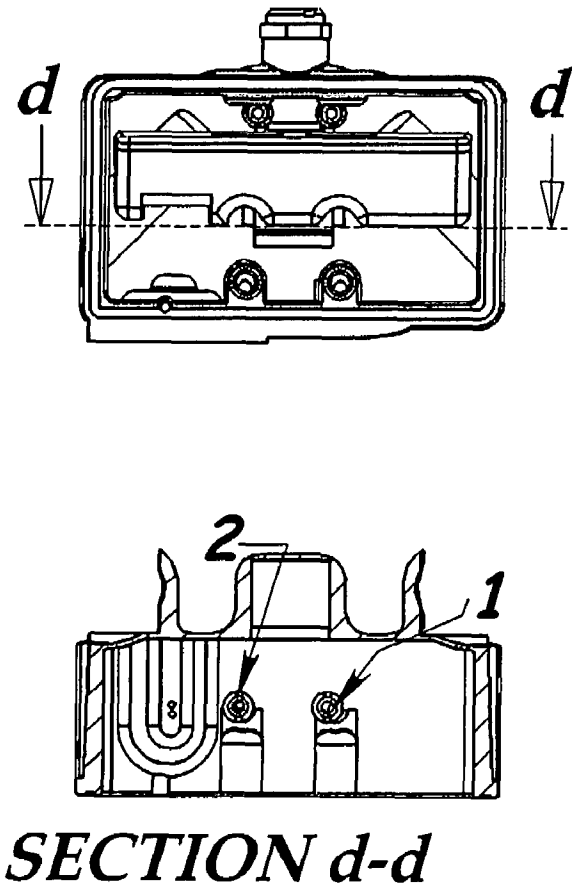

FIG. 10 shows a section view from the top showing the new location of the threaded jet holes.

Figure 11:
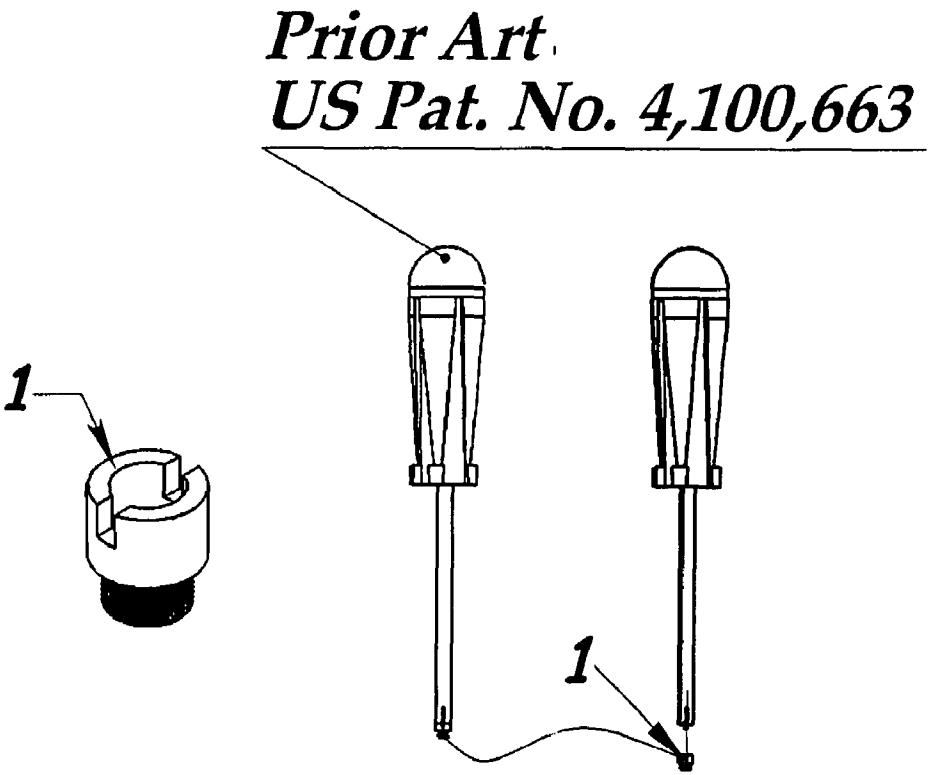

FIG. 11 shows jet and jet removal tool.

Figure 12:
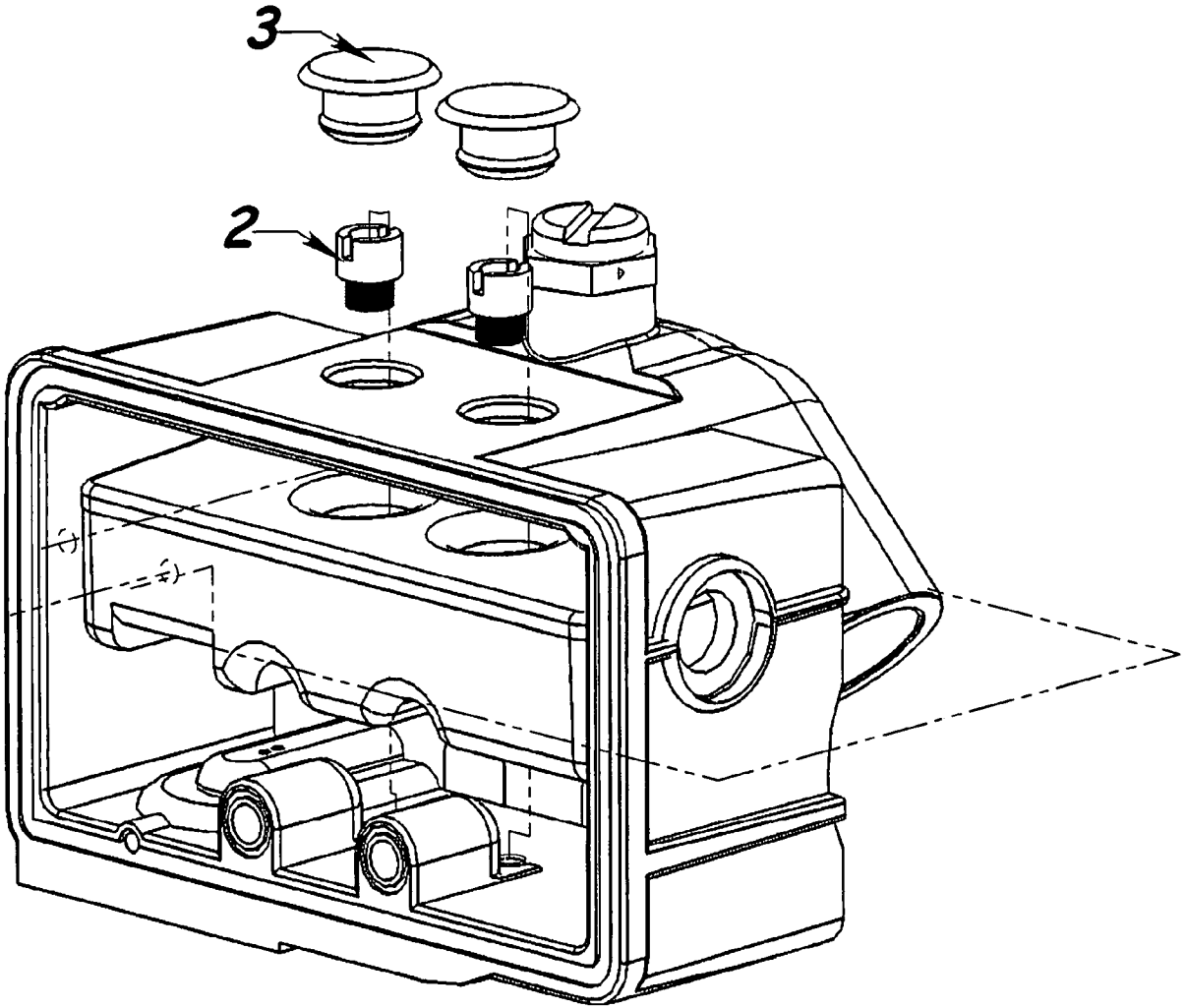

FIG. 12 shows isometric view with access plugs and metering jets in exploded view position.

REFERENCE NUMERALS

1 fuel jet 2(ea.)
2 new jet location
3 jet access plug
4 fuel flow passage
5 float
6 matching location to original metering block 2(ea.)
7 fuel float jet access passage
8 top access holes

DETAILED DESCRIPTION

FIG. 1 to FIG. 11—Preferred Embodiment

Figure 1:
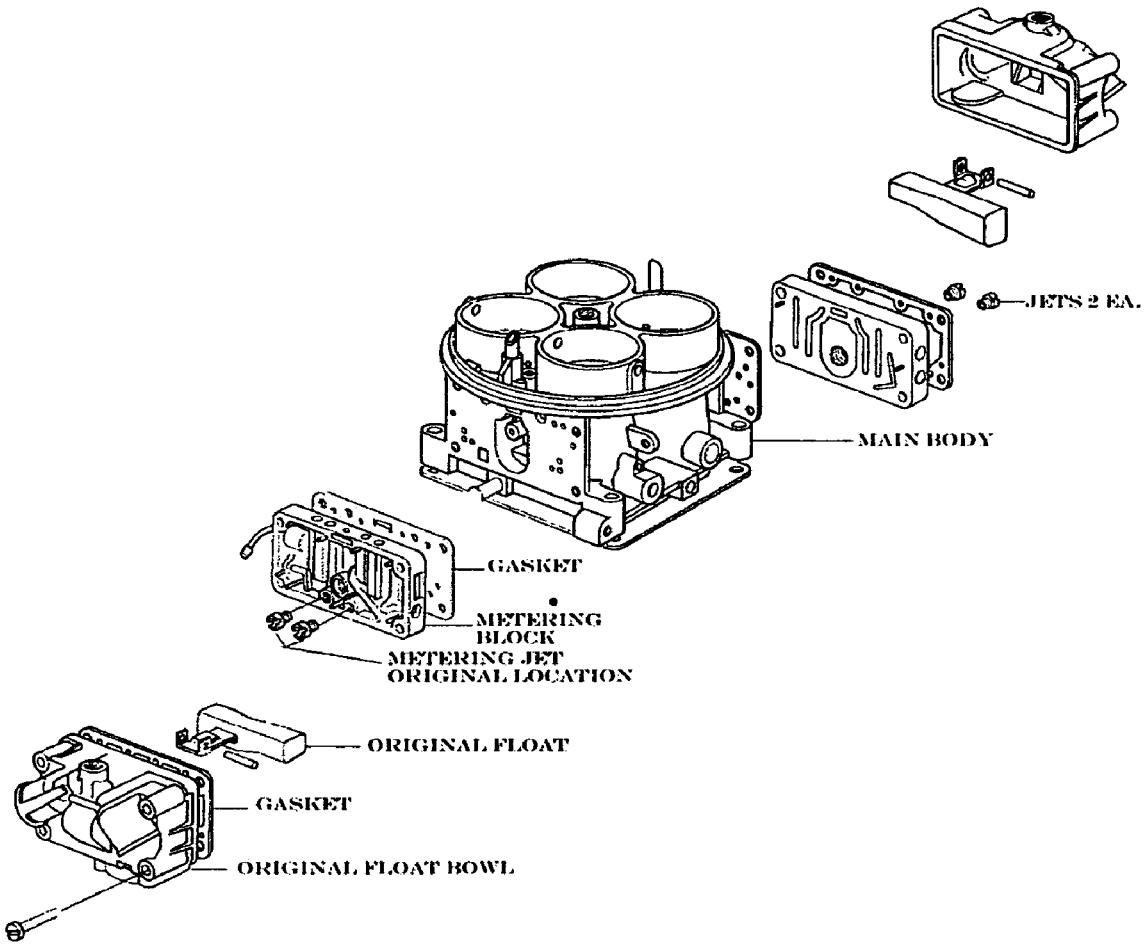
FIG. 1 PRIOR ART
FIG. 1 shows a typical carburetor described above, consisting of a main body, metering block, and fuel bowl, and the jets original location.
Figure 3:
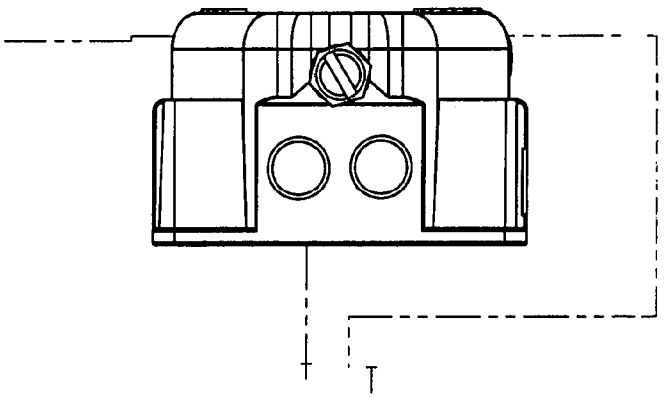
FIG. 3 shows an exploded 3 angle view showing related components.

Referring now to the drawings, FIG. 1 indicates an automobile carburetor, of the type for use of this invention, such as a Demon.RTM or Holley.RTM carburetor. Carburetors of this type include a main body having a mounted metering block mounted to the side. A float bowl mounted to the metering block. A fuel reservoir is accomplished as a result of a chamber created when the float bowl is sealed to the metering block. Gaskets seal the mating surfaces. The float pivots on a "hinge", created when secured via a pin and bracket to the back wall of the float bowl. This maintains a constant reservoir fuel level, by floating up and down shutting off incoming fuel to the adjusted level. Parts are secured to the main body using screws or bolts.

Shown also in FIG. 1 is the fuel metering jets, and their designed positions on the metering block.

Figure 2:
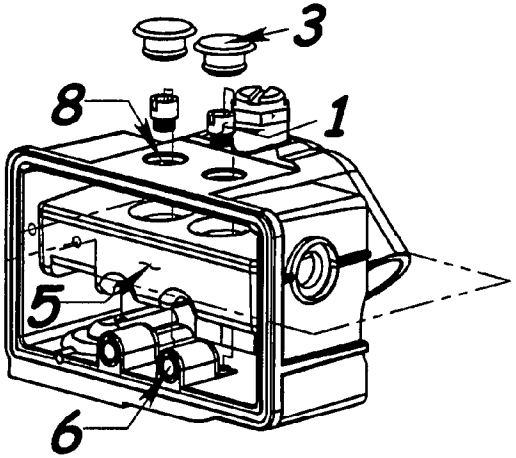
FIG. 2 shows an isometric exploded view of this invention, with the fuel float in its normal location, and the jets shown removed and (above) the fuel bowl.
Figure 4:
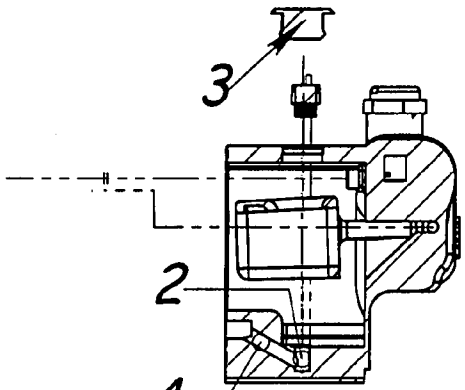
FIG. 4 shows the new jet location (2) and new fuel path passages (4), shown as sectional view a-a of the exploded assembly FIG. 3.

A preferred embodiment of the present invention is illustrated in FIG. 2 (isometric view). The original float bowl and float will be modified or replaced with ones having the following features. Access holes (8), in the top of the float bowl, a raised portion (6) on the bottom of the float bowl, float with passages (7) (FIGS. 5*a*, 8, and 9*a*), fuel delivery passage 4 (FIG. 4) and threaded holes (2) (FIG. 4 and FIG. 10). Holes (8), are aligned with holes (2), and float passage (7). Access holes (9) and passage (7) will be larger than the diameter of the fuel jet 1 (FIGS. 2 and 11) to allow for removal of the jet. Molded plastic or rubber plugs (3) (FIGS. 2 and 4) are friction fit into holes. Threaded plugs may also be an option. Plugs (3) will be used to keep foreign objects out of the fuel bowl when the carburetor is in normal use.

Operation

When a carburetor fuel jet change is required, the plugs (3) (FIG. 2) are removed, a tool(9) (FIG. 11) is inserted through holes (8) (FIG. 2) and float passage (7) (FIG. 8), with a gripping head of the jets (1) (FIG. 2) and the blade inserted in the slot in the rim of the jet. The jet (1) (FIGS. 2 and 11) is then unscrewed and extracted. The jet is held to the removal tool frictionally. Standard jets with a different sized aperture are then inserted in this invention's new jet location.

Accordingly, mechanics and others who regularly tune carburetors of the type described above will be able to safely, quickly and efficiently change the jets, without early gasket failure because of multiple removal and installations of the fuel float bowls. No dangerous removal of the float bowl with its inherent spillage of gasoline on hot manifolds is necessary. Also, there is a decreased chance of stripping the threads on the main body, because the fuel bowl will not be removed for jet changes. A more positive fuel presence is on the jet because of the new lower location in the fuel bowl. The engine which the carburetor is installed on is less likely to starve for fuel during hard accelerations, decelerations or cornering, thus enhancing performance of the carburetor with the fuel jet always covered with fuel.

Although the description above contains many specificities, these should not be construed as limiting the scope of the invention but as merely providing illustrations of some of the presently preferred embodiments of this invention. For example, the plugs can have other shapes, such as circular, oval, trapezoidal, triangular, etc.

Thus the scope of the invention should be determined by the appended claims and their legal equivalents, rather than by the examples given.

I claim:

1. A method of simplifying the changing of the fuel metering jets of a carburetor, the carburetor including a carburetor body, a metering block on the side of the carburetor, a pair of fuel passages located in the metering block, and a float chamber defined in part by the metering block and in part by a float bowl, said method comprising the steps:

A. positioning metering jets on the bottom wall of the float bowl, providing a flow path between the metering jets and the fuel passages in the metering block;

B. sealing the carburetor body, metering block, and float bowl with gaskets at mating surfaces;

C. providing access openings in an upper wall of the float bowl;

D. providing access passages in the float for removing the metering jets from the float bowl and replacing the metering jets without the need to remove the float bowl from the metering block and carburetor body.

2. The method of claim 1 wherein the metering jets include a threaded stem portion, a slot in a head portion, and a metering aperture extending through the metering jet, an upwardly facing threaded bore in the bottom of the float bowl being sized and threaded identically with the metering jets.

3. The method of claim 2 wherein the step of assembling metering jets within the upwardly facing threaded bore is by means of a screwdriver or gripping tool.

4. The method of claim 2 wherein the float bowl includes a metal, plastic, or combination of both.

5. The method of claim 1 wherein the access openings are holes, and the method including a step of inserting removable plugs in the holes.

6. The method of claim 5 wherein the removable plugs are molded of plastic or rubber and are either friction fit or threaded into the holes.

* * * * *